US009955826B2

(12) United States Patent
Staub

(10) Patent No.: US 9,955,826 B2
(45) Date of Patent: May 1, 2018

(54) FOAMING DISPENSER FOR TOILET PAPER

(71) Applicant: Jerry Staub, Plainview, NY (US)

(72) Inventor: Jerry Staub, Plainview, NY (US)

( * ) Notice: Subject to any disclaimer, the term of this patent is extended or adjusted under 35 U.S.C. 154(b) by 0 days. days.

(21) Appl. No.: 15/376,767

(22) Filed: Dec. 13, 2016

(65) Prior Publication Data

US 2017/0164793 A1 Jun. 15, 2017

Related U.S. Application Data

(60) Provisional application No. 62/266,697, filed on Dec. 13, 2015.

(51) Int. Cl.

| | |
|---|---|
| ***A47K 5/14*** | (2006.01) |
| ***A47K 10/32*** | (2006.01) |
| ***A47K 5/12*** | (2006.01) |
| ***B05B 7/24*** | (2006.01) |
| ***B05B 7/00*** | (2006.01) |
| ***B05B 15/06*** | (2006.01) |
| ***B05B 11/00*** | (2006.01) |

(52) U.S. Cl.

CPC ..... *A47K 5/14* (2013.01); *A47K 5/1217* (2013.01); *A47K 10/32* (2013.01); *B05B 7/0018* (2013.01); *B05B 7/241* (2013.01); *B05B 11/0054* (2013.01); *B05B 15/061* (2013.01); *A47K 2010/3273* (2013.01)

(58) Field of Classification Search

CPC ..... A47K 10/32; A47K 5/14; A47K 5/1217; A47K 2010/328; A47K 2010/3273; B05B 7/0018; B05B 7/241

USPC ..... 222/520, 87, 82, 52, 63, 399, 401

See application file for complete search history.

(56) References Cited

U.S. PATENT DOCUMENTS

| | | | | | |
|---|---|---|---|---|---|
| 2,746,798 | A | * | 5/1956 | MacArthur, Jr. | A47K 10/32 118/325 |
| 2,790,608 | A | * | 4/1957 | Sieven | A47K 10/32 242/560 |
| 3,837,595 | A | * | 9/1974 | Boone | A47K 10/32 242/594.5 |
| 3,865,271 | A | | 2/1975 | Gold | |
| 3,937,367 | A | * | 2/1976 | Hood | B05B 9/0833 141/17 |
| 4,106,616 | A | * | 8/1978 | Boone | A47K 10/32 206/233 |
| 4,354,643 | A | * | 10/1982 | Kenner | A47K 10/38 242/598.5 |

(Continued)

*Primary Examiner* — Nicholas J Weiss

(74) *Attorney, Agent, or Firm* — Kevin Keener; Keener & Associates P.C.

(57) ABSTRACT

An improved cleaning solution dispenser and method of use thereof. The apparatus comprises a casing and a cartridge. The casing comprises an external housing having a bottom portion with an outlet port, an air pump, and an injector connected to the air pump. The cartridge comprises an air tight reservoir containing a cleaning solution, a nozzle disposed on a bottom side reservoir, the nozzle having an opening disposed at an end point of the nozzle, and an injection point disposed at a top portion of the reservoir configured to receive the injector. The injector is configured to puncture a surface of the injection point. The air pump pumps air through the injector into the reservoir above the cleaning solution. The increased internal air pressure of the reservoir forces the cleaning solution through the nozzle.

16 Claims, 15 Drawing Sheets

(56) References Cited

U.S. PATENT DOCUMENTS

| | | | | | |
|---|---|---|---|---|---|
| 4,946,070 | A * | 8/1990 | Albert | A47K 5/1215 | 141/351 |
| 4,964,543 | A * | 10/1990 | Scheiber | A47K 10/32 | 222/180 |
| 5,312,021 | A * | 5/1994 | Nelson | A47K 10/32 | 221/96 |
| 5,443,084 | A * | 8/1995 | Saleur | A47K 10/32 | 134/122 R |
| 5,887,759 | A * | 3/1999 | Ayigbe | A47K 10/32 | 118/325 |
| 6,431,405 | B2 | 8/2002 | Irwin | | |
| 6,497,345 | B1 * | 12/2002 | Wilker | A47K 10/32 | 222/130 |
| 6,708,845 | B2 | 3/2004 | Weng | | |
| 9,375,745 | B2 | 6/2016 | Finch | | |
| 2014/0353334 | A1 * | 12/2014 | Ciavarella | A47K 5/16 | 222/52 |

* cited by examiner

FOAMING DISPENSER FOR TOILET PAPER

PRIORITY

This application claims priority to U.S. Provisional Patent Application Ser. No. 62/266,697 filed Dec. 13, 2015, the disclosure of which is hereby fully incorporated by reference.

FIELD OF THE INVENTION

The invention pertains generally to sanitation liquid dispensers and more particularly to an automatic foam dispenser for dispensing a sanitation solution onto a portion of toilet tissue.

BACKGROUND OF INVENTION

Toilet tissue is used for personal cleaning after a person has finished expelling waste in one form or another. Dry toilet tissue has a high propensity to leave incomplete results, alongside with having a potential for irritating a user's skin if used too repetitively. Baby wipes or wet wipes that use nonwoven fabric materials are designed for babies in diapers, which have fundamentally different and more comprehensive needs than individuals using toilets. With these products come unnecessary drawbacks, such as wipes which are marketed as flushable but actually do not disintegrate easily in water, cost, environmental waste and inconvenient packaging/positioning.

Wet wipes generally have two components—the nonwoven fabric material which is saturated with cleaning liquid solution. Purchasing and utilizing standard wet wipes can lead to a waste of material or cleaning solution. Often there is excess solution remaining in a package when the package has been emptied. Also, each individual wipe is often over saturated. Consumers do not have the option of choosing the amount of solution to utilize on each individual wipe. What is needed is a system and method of use which permits a user to place cleaning solution on a portion of toilet tissue where the user chooses the correct amount of toilet tissue and the correct amount of cleaning solution for the situation faced by the consumer at each instance.

In addition, wet wipes are pre-moistened for use by a user. Because wet wipes are pre-moistened, the material utilized for wet wipes is required to be a sturdier nonwoven fabric. If standard toilet tissue were utilized in prepackaged wet wipes, the material would disintegrate into a blob of wet pulp. The invention solves this problem by permitting a user to add cleaning solution to standard toilet tissue, which may be made of a thinner and less sturdy material than wet wipes.

Other devices are taught which can be utilized for a similar purpose of the present invention. However, these devices are imperfect solutions. U.S. Pat. No. 9,375,745 (Finch) teaches a device similar to the present invention. Finch does not teach a rotational arm as taught by the present invention. Thus, the device taught by Finch is not as stable when hung on a spindle. In addition, Finch teaches the use of a fluid pump instead of the air pump utilized by the present invention. The use of air pressure in the present invention permits a higher internal pressure to be developed in the reservoir. This permits the present invention to expel the vast majority of cleaning solution. In addition, the higher pressure permits the present invention to expel cleaning solution with greater force and speed—decreasing the amount of time needed to utilize the present invention. Therefore, the present invention solves problems not solved by other known devices.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward an apparatus for dispensing a solution comprising a casing and a cartridge. The casing comprises an external housing having a bottom portion with an outlet port, an air pump, and an injector connected to the air pump. The cartridge comprises an air tight reservoir containing a cleaning solution, a nozzle disposed on a bottom side reservoir, the nozzle having an opening disposed at an end point of the nozzle, and an injection point disposed at a top portion of the reservoir configured to receive the injector. The injector is configured to puncture a surface of the injection point. The air pump pumps air through the injector, into a top portion of internal space of the reservoir above the cleaning solution. As air is pumped into the top portion of internal space of the reservoir increased internal air pressure of the reservoir forces the cleaning solution through the nozzle. The opening of the nozzle is disposed above the outlet port of the external housing.

In another embodiment of the invention the casing further comprises a spindle hook connected to the external housing of the casing, a rotating arm rotably connected to the spindle hook, and a thumb screw and a nut removably securing the rotating arm to a portion of the spindle hook.

The apparatus may further comprise a manual pump button disposed in the casing and connected to the air pump. Alternatively, the apparatus may further comprise a power source, and an electric motor connected to the air pump.

In another embodiment of the invention, the apparatus further comprises a motion sensor and a printed circuit board. The printed circuit board is configured to activate the air pump when the printed circuit board receives an activation signal from the motion sensor.

In another embodiment, the invention further comprises a cartridge ejection system.

In another embodiment, the external housing comprises a side wall having an upper rim defining a top opening. The cartridge further comprises a top cover. The top cover is disposed adjacent to the upper rim when the cartridge is placed within the casing.

In another embodiment the nozzle further comprises an aerator.

In another embodiment the apparatus further comprises one or more indicator lights.

In another embodiment the cartridge further comprises a metal foil electrical connection disposed on a bottom portion of the cartridge.

The casing further comprises one or more electrical connection points wired to the air pump and a cartridge ejection button disposed in the bottom portion. The one or more electrical connection points are electrically connected to the metal foil electrical connection when the cartridge is fully inserted into the casing. An internal surface of the cartridge ejection button servers the metal foil electrical connection when the ejection button is used to eject the cartridge from the casing.

In another embodiment the apparatus further comprises a valve disposed in the outlet port.

In another embodiment of the invention the casing further comprises a transparent window disposed in the external housing.

The reservoir further comprises a transparent portion. A portion of the cleaning solution is visible through the transparent window of the external housing and the transparent portion of the reservoir when the cartridge is disposed in the casing.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

As used in this application, the terms "component", "module", "system", "interface", or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component.

Figure 1:
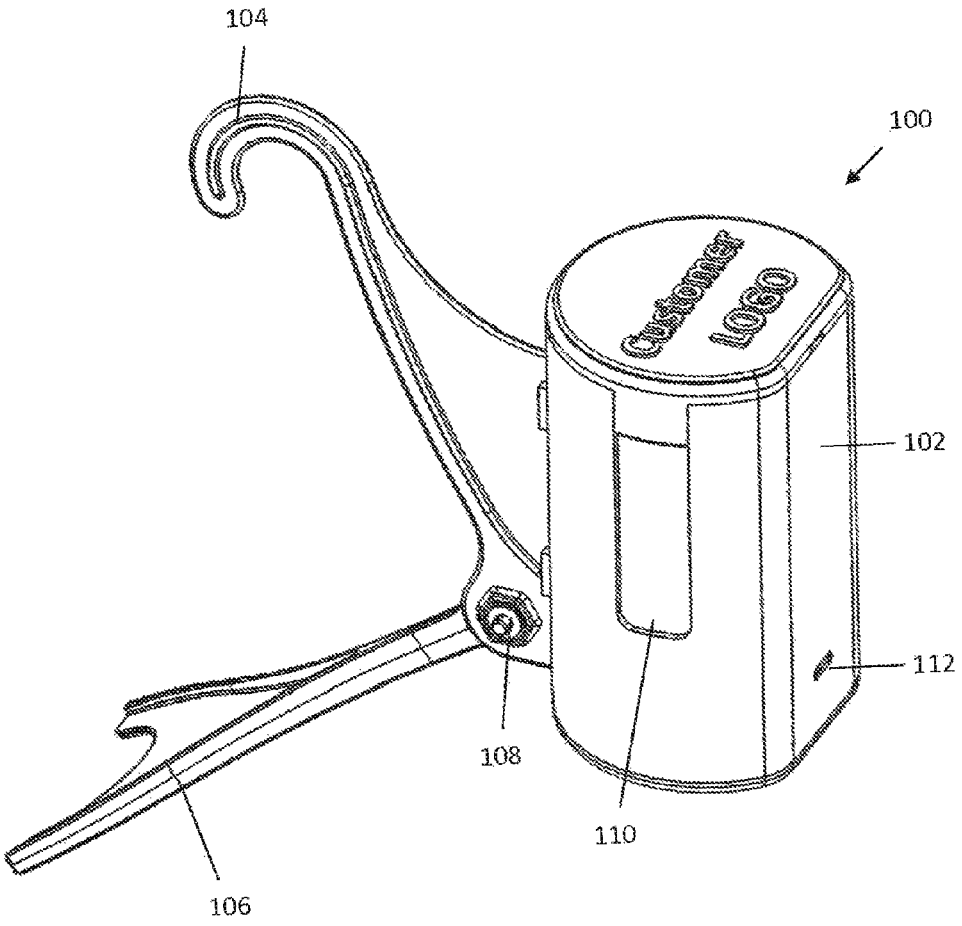
FIG. 1 is a top left perspective view of the dispenser.

Referring to FIGS. 1-15, the preferred embodiment of the dispenser 100 is illustrated. Referring to FIGS. 1-6, the preferred embodiment of the external configuration of the dispenser 100 is illustrated. The dispenser 100 comprises a casing 102 made up of an external housing making up the body of the dispenser 100. The casing 102 may be any size and shape. In the preferred embodiment the casing 102 is primarily cylindrical in shape, although other shapes may be utilized such as cuboid. As illustrated in FIG. 1, the casing 102 may have a window 110 which permits a user to see the underlying cartridge 300. The window 110 may be an aperture disposed in the side of the casing 102. In other embodiments, the window 110 is a transparent thermoplastic material.

The casing 102 is configured to be mounted in a bathroom for use by a user. The casing 102 can be mounted at any location and means in a bathroom. For instance, the casing may be mounted on a wall by hanging the casing on a screw or base which is removably secured to a wall. Alternatively, as illustrated in the drawings, the dispenser 100 may have a spindle hook 104 connected to the casing 102. The spindle hook 102 may be any size and shape. In the preferred embodiment the spindle hook 102 has a curved body end permitting the user to place the spindle hook 104 over a spindle holding a roll of toilet paper. The spindle hook 104 may also be used to hang the casing over a towel rod or other handle already present in a bathroom. The spindle hook 104 permits the dispenser 100 to be portable and positioned and repositioned as desired by a user. The casing 102 may also have a rotating arm 106 which is removably secured to the spindle hook 104. The rotating arm 106 may be any size and shape. The rotating arm 106 may be rotably connected to the spindle hook 104 or external housing of the casing 102 at any position on the external surface of the dispenser 100. The rotating arm 106 may be rotably connected by any known means which permits the user to rotate the position of the rotating arm 106 relative to the casing 102. In the preferred embodiment illustrated the rotating arm 106 is rotably connected to a lower portion of the spindle hook 104 by a thumb screw 114 and nut 108. The thumb screw 114 may be loosened and tightened into the nut 108. A user can tighten the thumb screw 114 into the nut 108 to lock the rotating arm 106 into a desired position. When the user wants to change the position of the rotating arm 106, the user loosens the thumb screw 114 from the nut 108, repositions the rotating arm 106, and tightens the thumb screw 114 into the nut 108 to lock the rotating arm 106 into its new position. The rotating arm 106 is utilized to keep the casing 102 of the dispenser 100 in a relatively vertical orientation. The end of the rotating arm 106 distal from the casing 102 is positioned to contact the wall to which the spindle is connected—keeping the dispenser 100 in a desired position and prevent the dispenser 100 from swinging in any horizontal direction while the spindle hook 104 is hanging on a rod or spindle.

Figure 2:
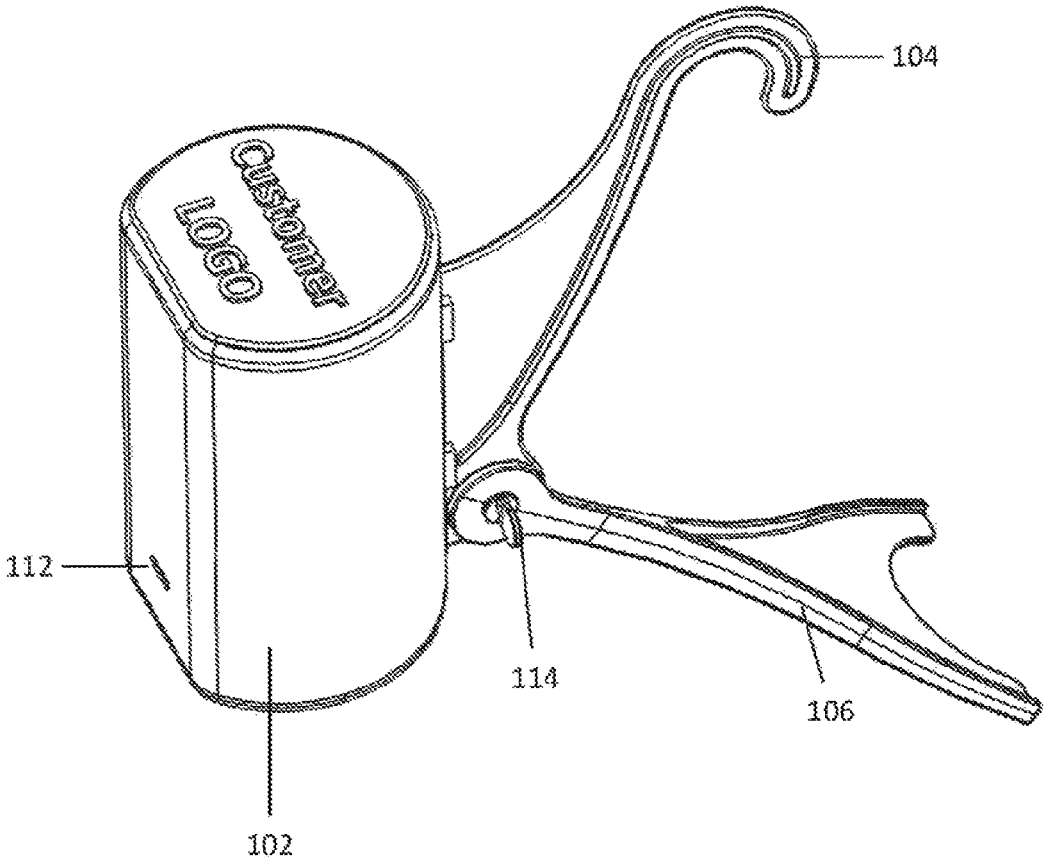
FIG. 2 is a top right perspective view of the dispenser.
Figure 4:
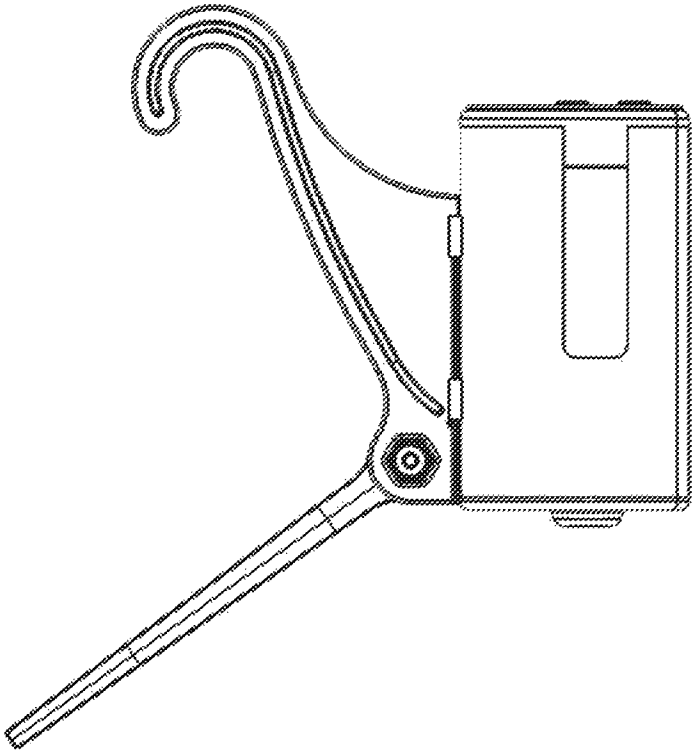
FIG. 4 is a left plan view of the dispenser.
Figure 3:
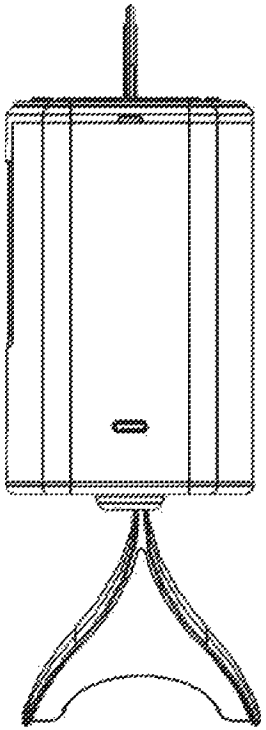
FIG. 3 is a front plan view of the dispenser.
Figure 5A:
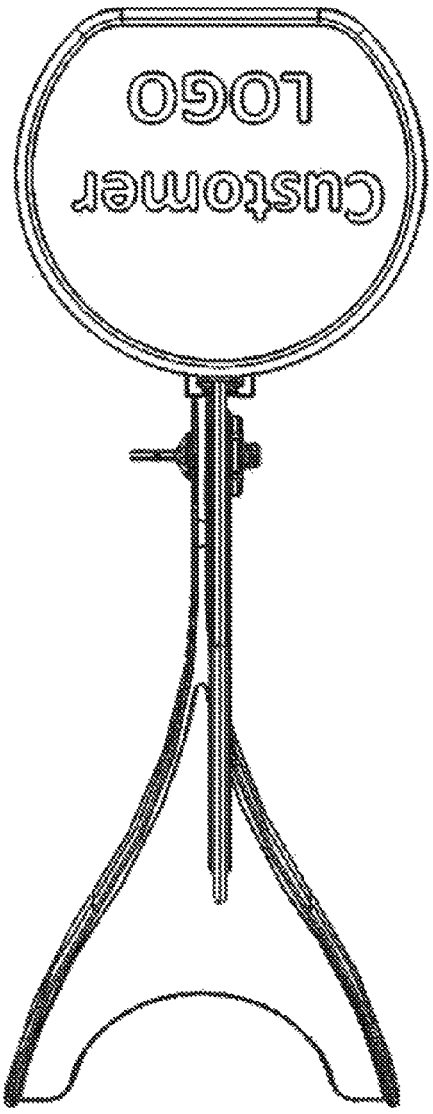
FIG. 5A is a top plan view of the dispenser.
Figure 5B:
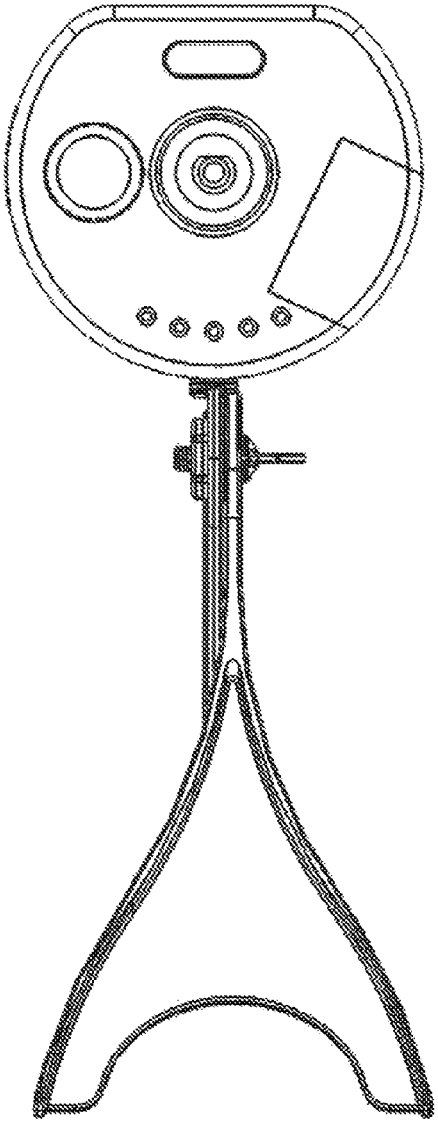
FIG. 5B is a bottom plan view of the dispenser.

As shown in FIG. 1-2, the casing 102 may have an indicator light 112. The indicator light 112 may be any size and shape. The indicator light 112 may be any type of light, such as an LED. The indicator light 12 may be any single color or a combination of colors. In another embodiment there are a plurality of indicator lights 112. In the preferred embodiment the indicator light 112 lights when a cartridge 300 is empty and needs to be replaced. In one embodiment the indicator light 112 enlightens when the cartridge 300 is empty. In another embodiment, the indicator light 112 may change color (such as from green to red) when the cartridge 300 is empty.

Figure 6:
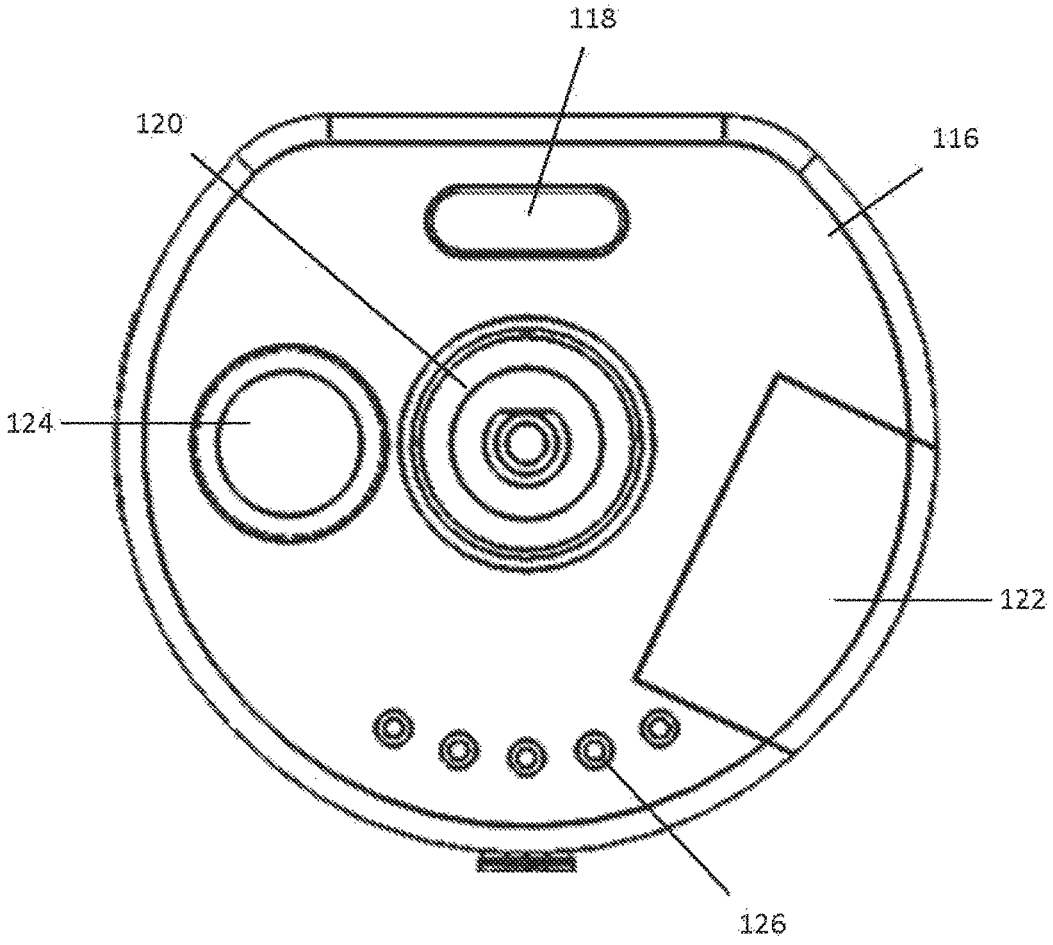
FIG. 6 is a bottom view of the dispenser.
Figure 7:
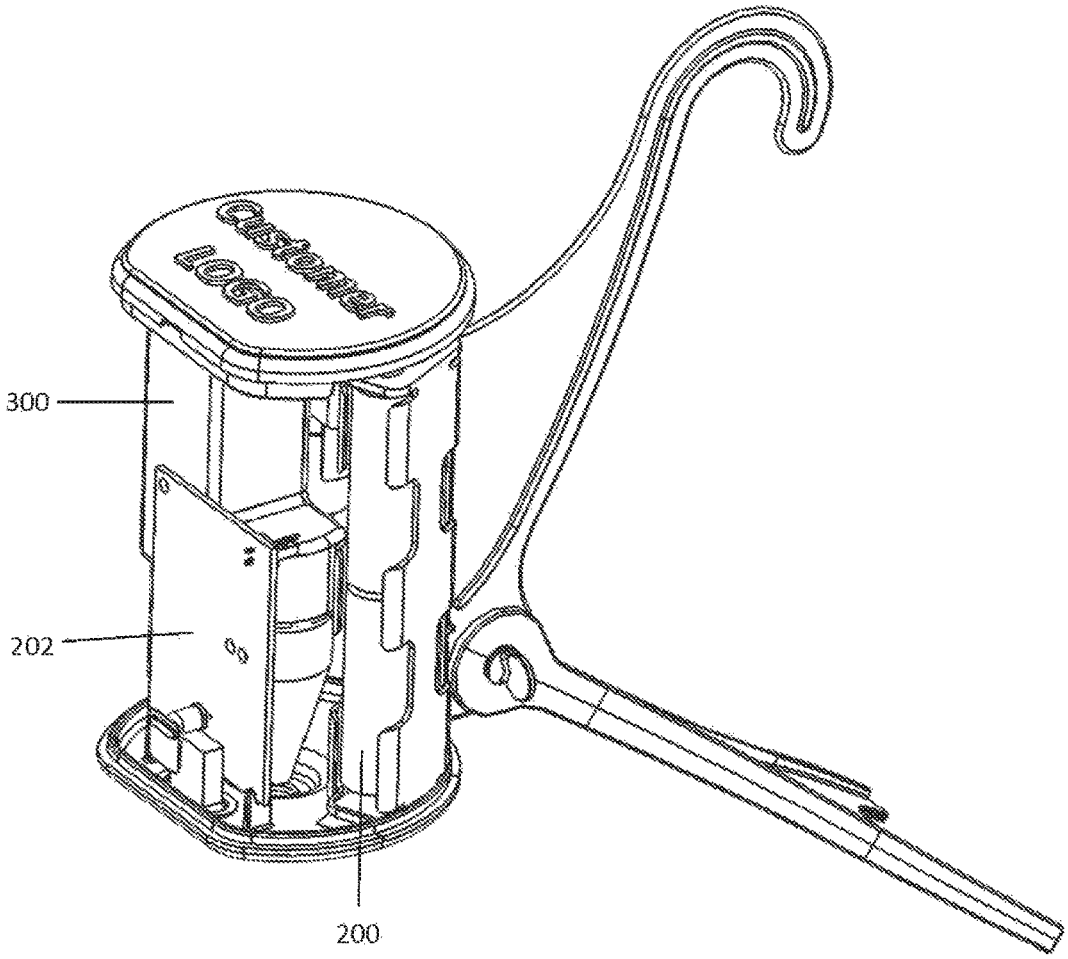
FIG. 7 is a top right partial cutaway view of the dispenser.
Figure 8:
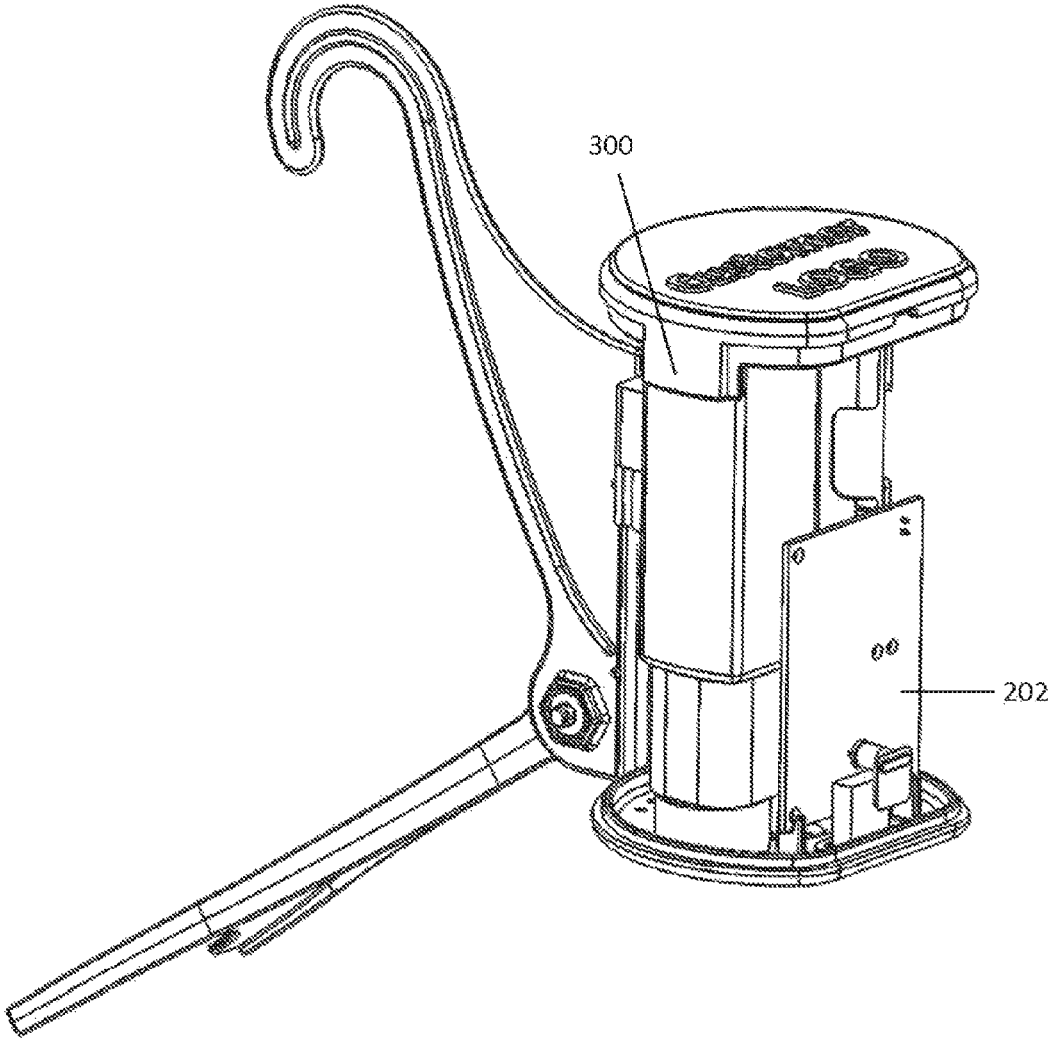
FIG. 8 is a top left partial cutaway view of the dispenser.
Figure 9:
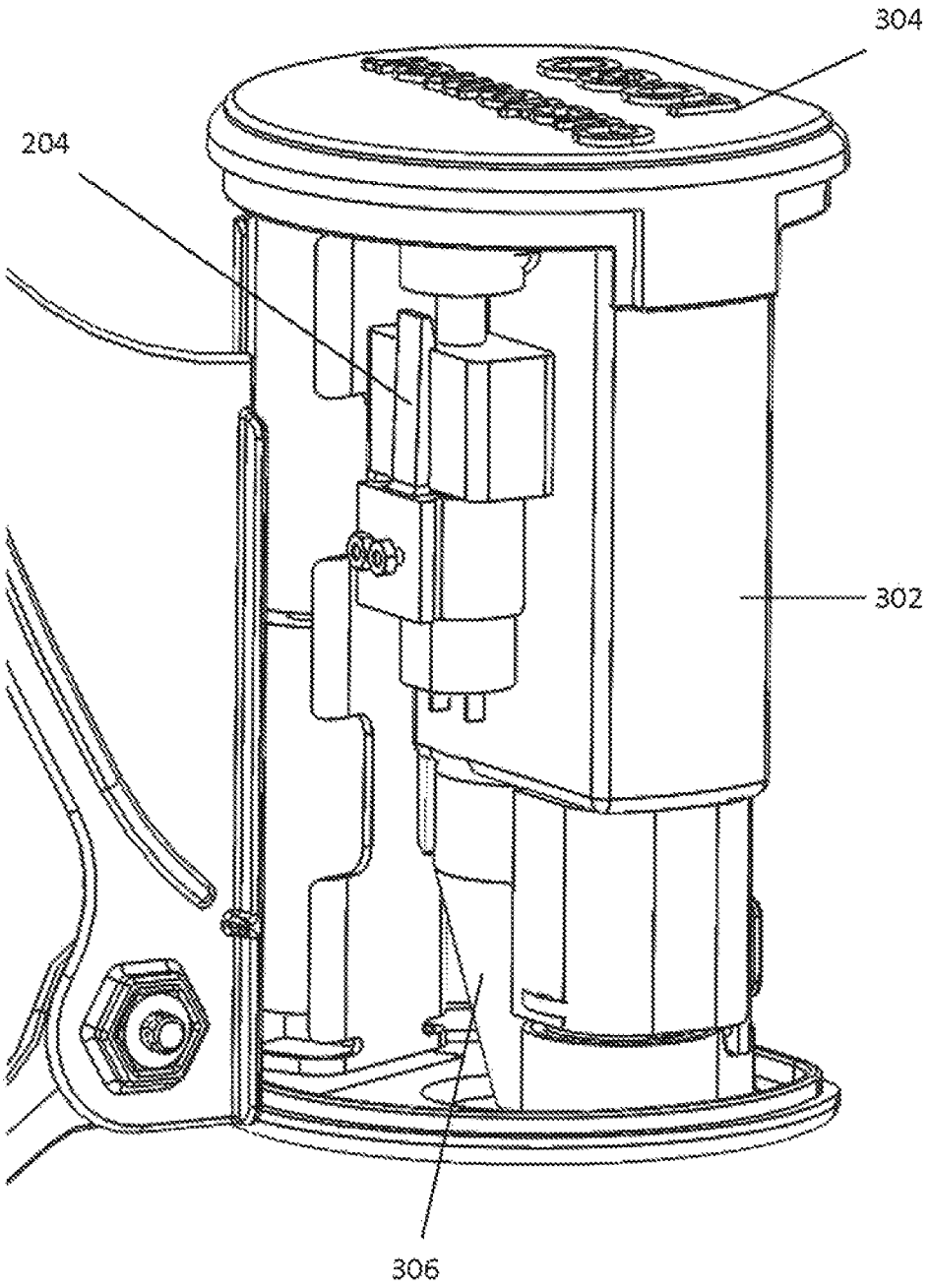
FIG. 9 is a left side partial cutaway view of the dispenser.

Referring to FIG. 6, a bottom side 116 of the casing 102 is illustrated. In the preferred embodiment the bottom side 116 has a battery cover 122 covering a battery compartment. The bottom side also has a cartridge ejection button 124 which is utilized to eject the cartridge 300 from the casing 102. The bottom side 116 may have one or more lights 126. The lights 126 may be any size, shape, and color. In the preferred embodiment the lights 126 are night lights which only enlighten when the bathroom is dark, permitting a user to see and use the dispenser 100 in the middle of the night without turning on the lights. The bottom side 116 also has an opening for a motion sensor 118. The motion sensor 118 is configured to activate the dispenser 100 when motion is detected underneath the dispenser 100. Also disposed in the bottom side 116 is an outlet port 120. The outlet port 120 may be any size and shape. The outlet port 120 permits cleaning solution from the cartridge 300 to pass through the bottom side 116 of the casing 102 when the dispenser 100 is activated. The outlet port 120 may come in any known configuration. For instance, as illustrated, the outlet port 120 may have a cover valve which closes up the outlet port 120 when the dispenser 100 is not activated to prevent leakage of any cleaning solution when the dispenser 100 is not being utilized.

Referring to FIGS. 7-12, the internal components of the dispenser 100 are illustrated. The dispenser utilizes one or more batteries 200 as a power source to power the electrical components of the dispenser 100. In other embodiments the batteries 200 may be replaced by a rechargeable battery pack. In other embodiments where the dispenser is permanently secured to a wall the dispenser 100 may lack batteries 200 and instead be hardwired into existing electrical wiring in the bathroom.

In the preferred embodiment, the dispenser 100 utilizes a printed circuit board 202. The printed circuit board 202 controls the processing and operation of the separate electrical components of the dispenser 100. The printed circuit board 202 may contain a processor chip and a memory unit. The printed circuit board 202 may contain instructions for the operation and control of the air pump 204, the motion sensor 118, indicator light, 112, and lights 126.

As shown in the drawings, the casing 102 holds a cartridge 300. The cartridge 300 is a container used for holding a cleaning solution. In one embodiment the cartridge 300 is refillable, permitting a user to refill the cartridge 300 with additional cleaning solution when the cartridge 300 is empty. In another embodiment the cartridge 300 is configured for one-time use. In this embodiment, when the cartridge 300 is empty the user removes the original cartridge 300 and inserts a new cartridge 300.

The cartridge 300 comprises a reservoir 302, a cover 304, a nozzle 306, an ejection block 308, and an injection point 312. The reservoir 302 is a shaped container for holding the cleaning solution. The reservoir 302 may be any size and shape. The reservoir 302 may be made of any material such as metal or thermoplastic. The reservoir 302 may be transparent or translucent permitting a user to see the amount of cleaning solution inside in the reservoir 302. The reservoir 302 may be air tight to prevent leakage of cleaning solution. In another embodiment the reservoir 302 may be pressurized. In another embodiment the reservoir 302 may have a plurality of internal compartments, each holding a different ingredient of the cleaning solution which are then mixed together and expelled as the cleaning solution from the nozzle. In another embodiment the printed circuit board 202 controls a plurality of internal valves in the reservoir 302 to change the composition of the cleaning solution as chosen and directed by the user. The cleaning solution contained in the reservoir 302 may be any type of soap based cleaning solution which is known or used in the industry to clean skin.

On the top side of the cartridge 304 is a top cover 304. The top cover 304 is configured to appear as the outside of the casing 102. The top cover 304 is configured to complement a top rim 128 of the casing 102. When the cartridge 300 is inserted into the casing 102, the user places the cartridge 300 in through the top aperture defined by the top rim 128. The top cover 304 then snaps into place within the top rim, locking the cartridge 300 into the internal space of the casing 102 and preventing the removal of the cartridge 300.

Disposed at the bottom of the cartridge 306 is a nozzle 306. The nozzle 306 may be any size and shape. In the preferred embodiment the nozzle 306 is a conical shape ending in a lower port which permits the cleaning solution to exit the cartridge 300. The lower port of the nozzle 306 is disposed above the outlet port 120 of the bottom side 116 so that as cleaning solution exits the nozzle 306, the cleaning solution exits immediately through the outlet port 120. In other embodiments the lower port of the nozzle 306 is connected to one or more internal tubes which are used to hold and transfer the cleaning solution to the outlet port 120. In the preferred embodiment the nozzle contains an internal aerator (not shown) which causes the cleaning solution to change from liquid to foam. The aerator may be any known device used for imparting air into the cleaning solution. The aerator may be a wire mesh component, a sponge material, a straw with side openings to add air, or any other known foaming element which is configured to change a cleaning solution from liquid to foam or lather.

The air pump 204 is utilized to pump air into the reservoir 302. The air pump 204 may be operated by an electric motor in the preferred embodiment. In other embodiments the air pump 204 is operated by manual operation to pump air into the reservoir 302. To operate manually the user may push down on the top of the top cover 304, pushing the cartridge 300 further into the casing 102 and operating the air pump 204. In other embodiments the dispenser 100 may have a separate button or pump disposed in the outer surface of the casing 102 to operate the air pump 204 either via the electric motor or by manual operation.

Figure 11:
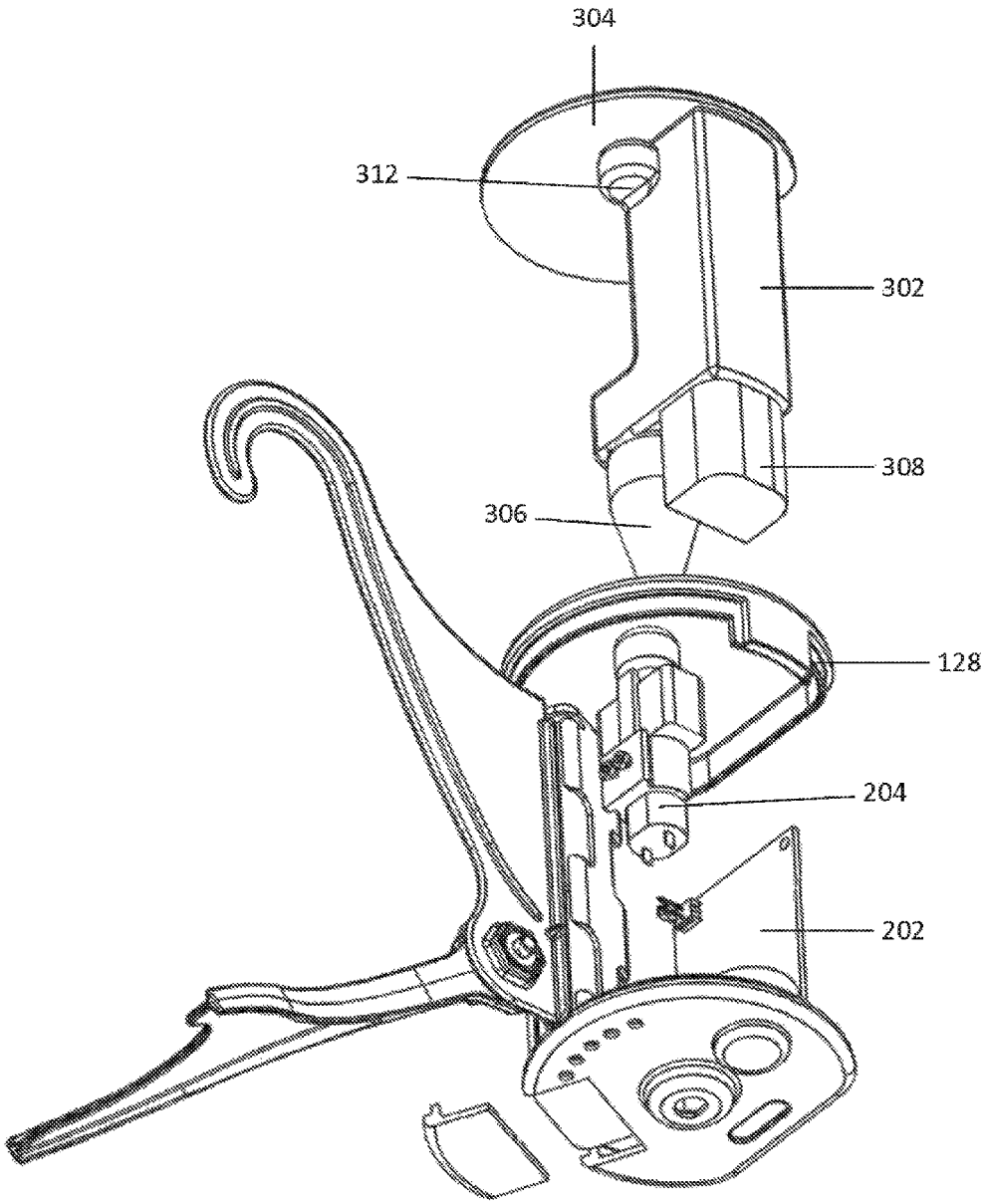
FIG. 11 is a bottom left perspective of a partially exploded view of the dispenser.
Figure 12:
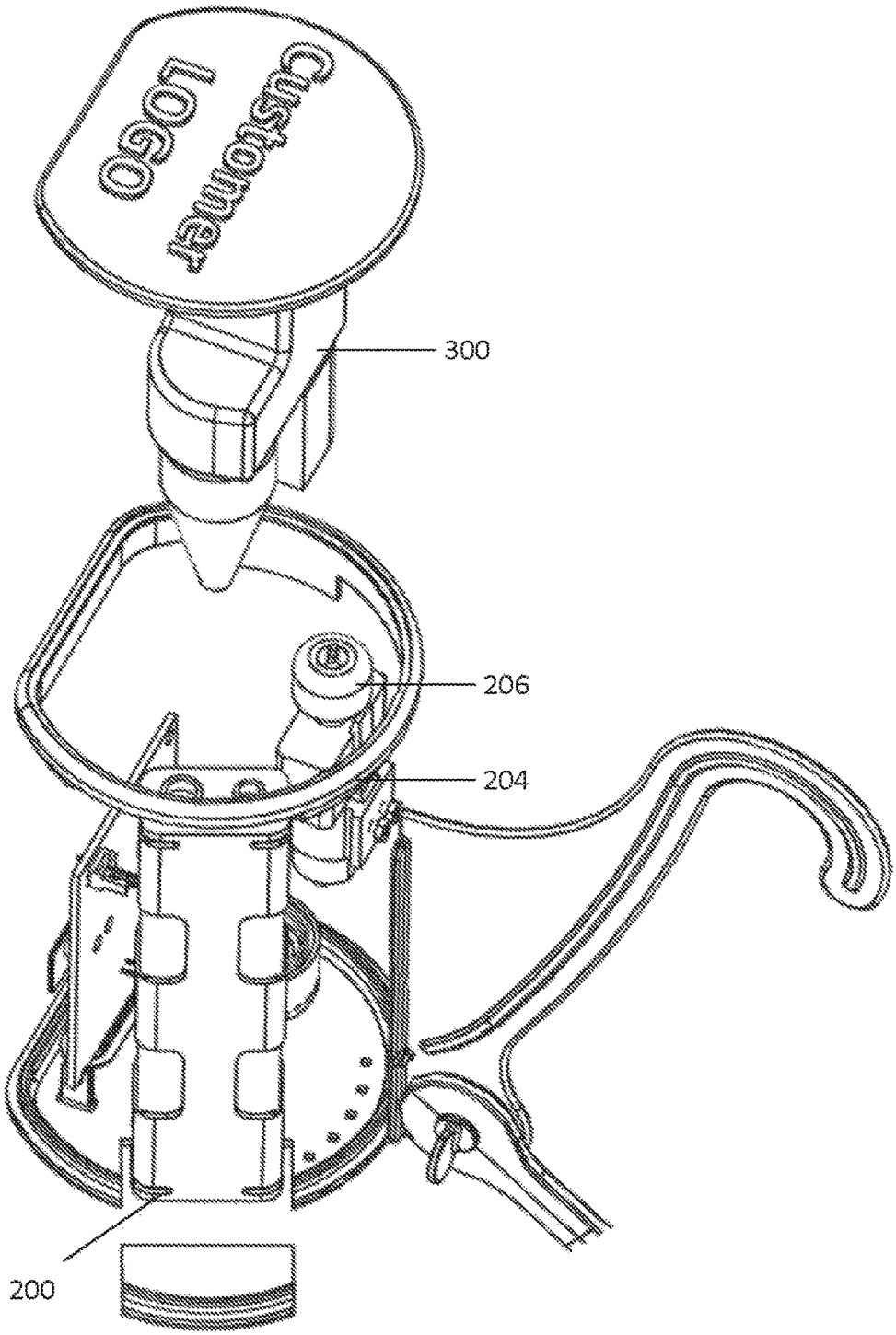
FIG. 12 is a top right perspective of a partially exploded view of the dispenser.
Figure 13:
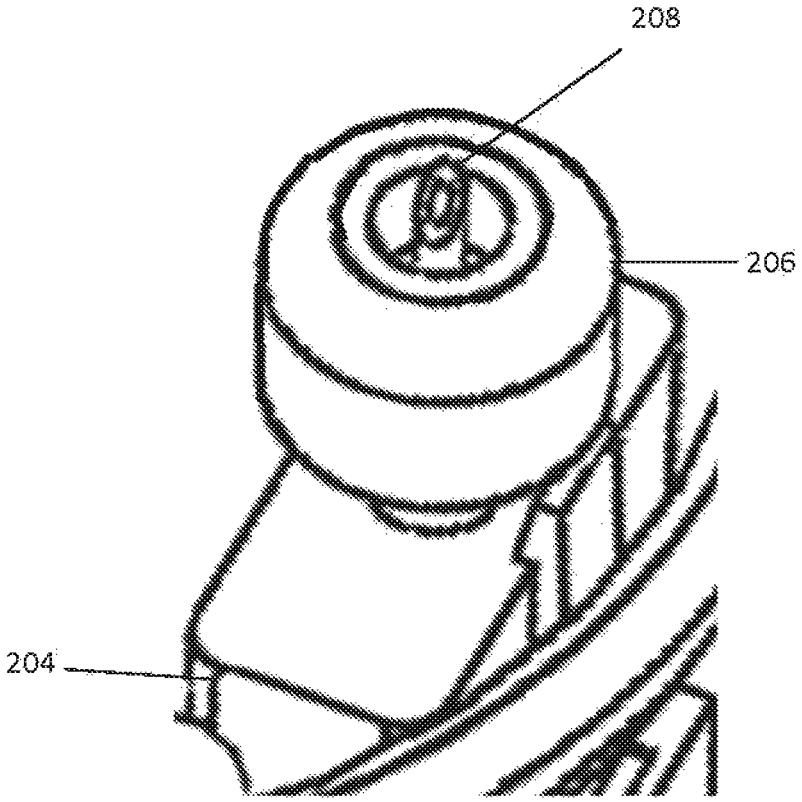
FIG. 13 is an enhanced view of the injector.
Figure 14:
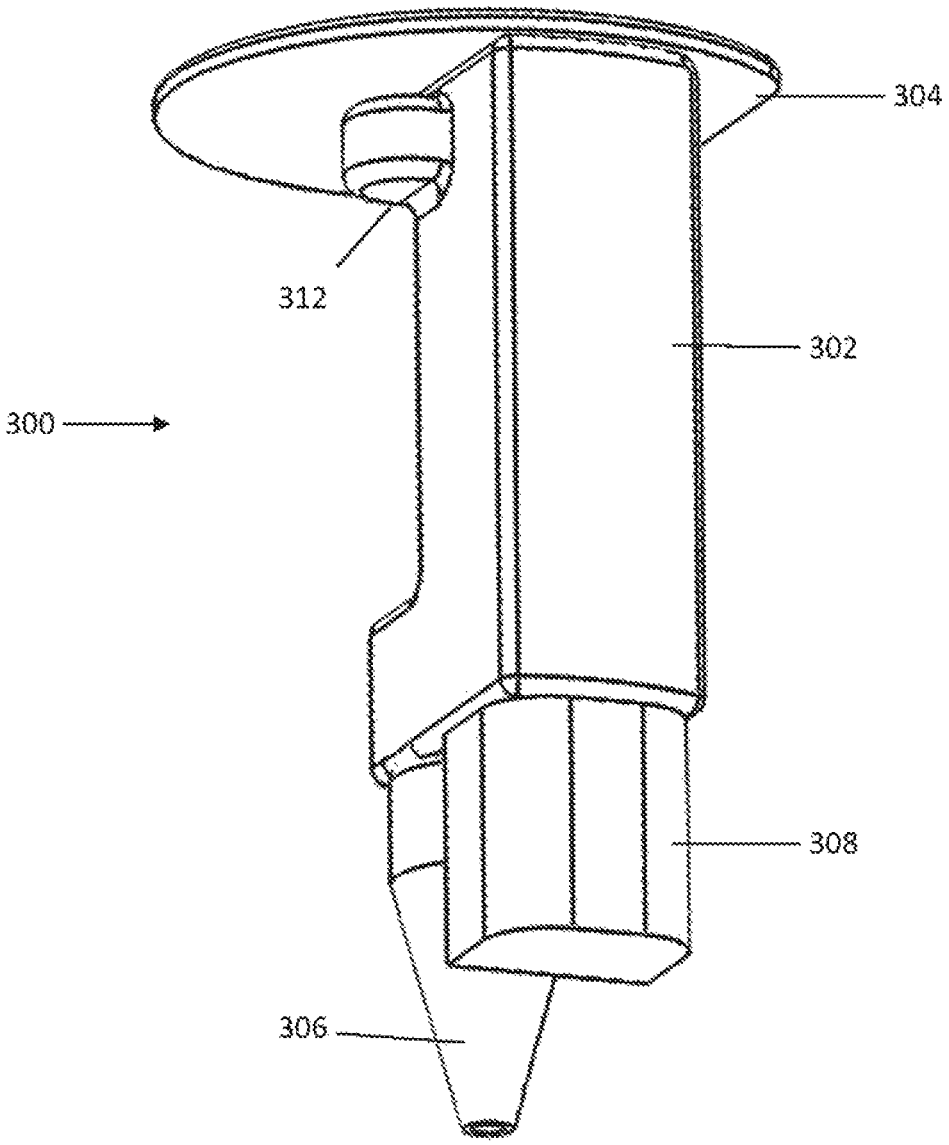
FIG. 14 is a side view of the cartridge.

The cartridge 300 also has an injection point 312 which is disposed at the top part of the reservoir 302 as shown in FIG. 11. The injection point is configured to be punctured by the injector 206. As shown in FIG. 13, the injector 206 is connected to the air pump 204 and has a needle 208. When a user fully inserts the cartridge 300 into the casing 102, the needle 208 of the injector 206 punctures the injection point 312 of the reservoir 302. The needle 208 is a hollow pointed tube through which air is pumped by the air pump 204. The needle 208 of the injector 206 is inserted into the upper portion of the reservoir 302, into air space in the reservoir 302 above the cleaning solution. As the air pump 204 is activated, the air pump 204 pumps air through the needle 208 of the injector 206 into the upper portion of the reservoir 302. As air is pumped into the reservoir 302, the internal increase in air pressure cause the cleaning solution to exit through the nozzle 306. The needle 208 of the injector 206 may puncture the reservoir 302 at any angle, orientation or location. The injection point 312 of the reservoir 302 may be located at any point on the reservoir 302.

Figure 10:
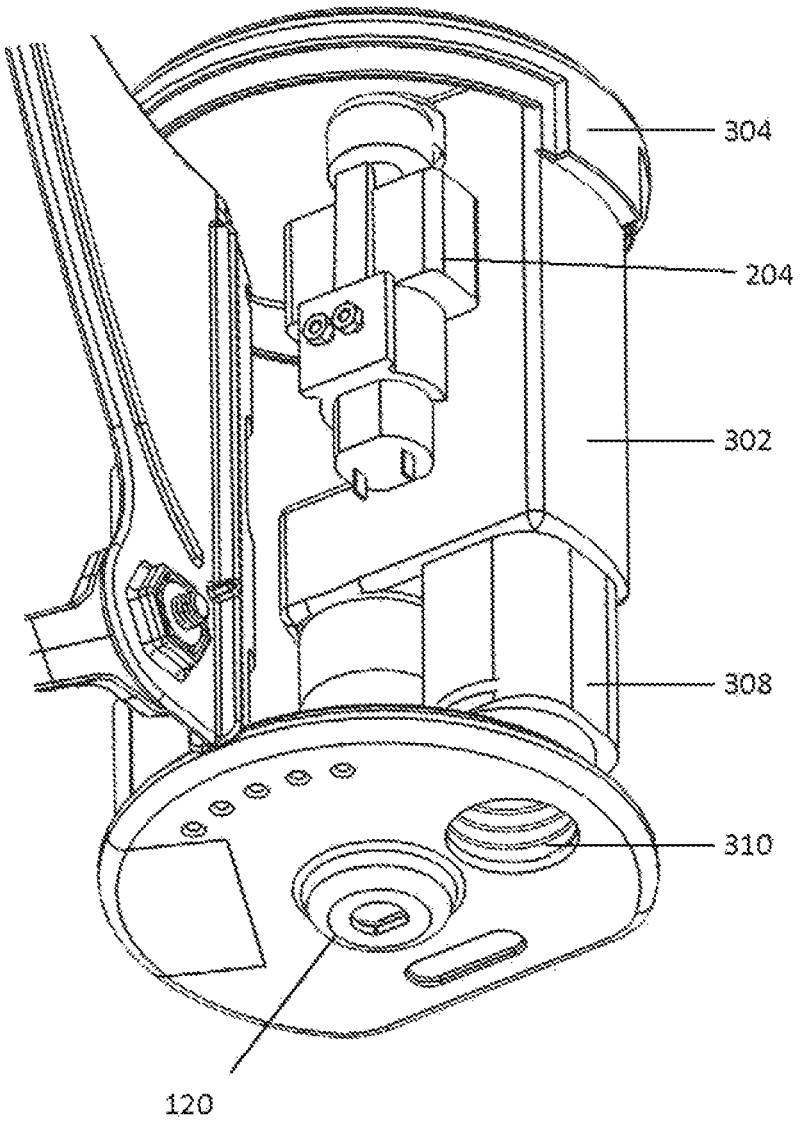
FIG. 10 is a bottom left partial cutaway view of the dispenser.

When a cartridge 300 is empty and the user needs to remove the cartridge 300 the user pushes on the ejection button 124. As shown in FIG. 10, behind the ejection button 124 is a spring 310 which pushes the ejection button outward after a user pushes the ejection button 124. The ejection button 124 pushes against the ejection block 308 to push the cartridge 300 upward and out through the aperture defined by the top rim 128.

Figure 15:
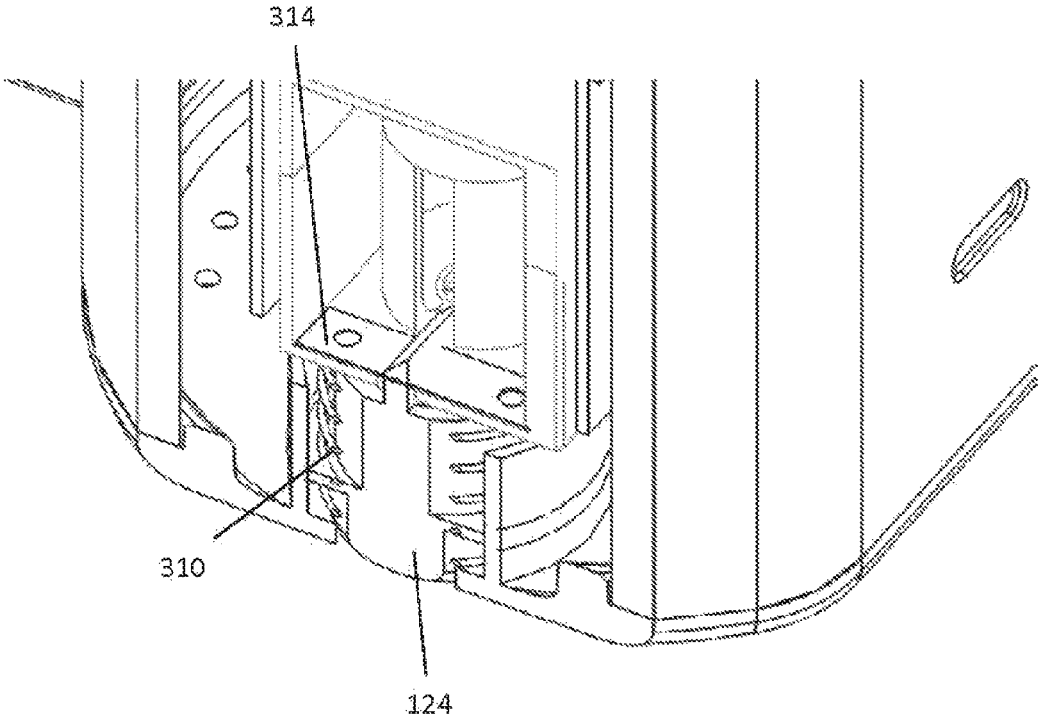
FIG. 15 is a cutaway view of the kill switch system.

Referring to FIG. 15, the embodiment of a one-time use cartridge 300 is illustrated. In this embodiment the ejection block 308 contains a metal foil connector 314. The metal foil connector 314 is electrically connected to the batteries 200 and the other electrical components. When the cartridge 300 is inserted in the casing 102, the metal foil connector 314 completes the electrical circuit between internal electrical connection points. In this embodiment the motor of the air pump 204, and other components, cannot operate unless a cartridge 300 is inserted and the metal foil connector 314 completes the electrical circuit. When a user then ejects the cartridge, a portion of the ejection button 124 severs the metal foil connector 314. Thus, if a user tries to place the same cartridge 300 back into the casing 102, the electrical circuit will not be completed and the motor of the air pump 204 will not operate, even if there is cleaning solution contained in the reservoir 302.

In the preferred embodiment, the ejection button 124, spring 310, and ejection block 308 forms an ejection system. In other embodiments the ejection system may utilize different components to eject the cartridge 300 from the casing 102, such as other buttons or levers disposed in the casing 102.

Figure 16:
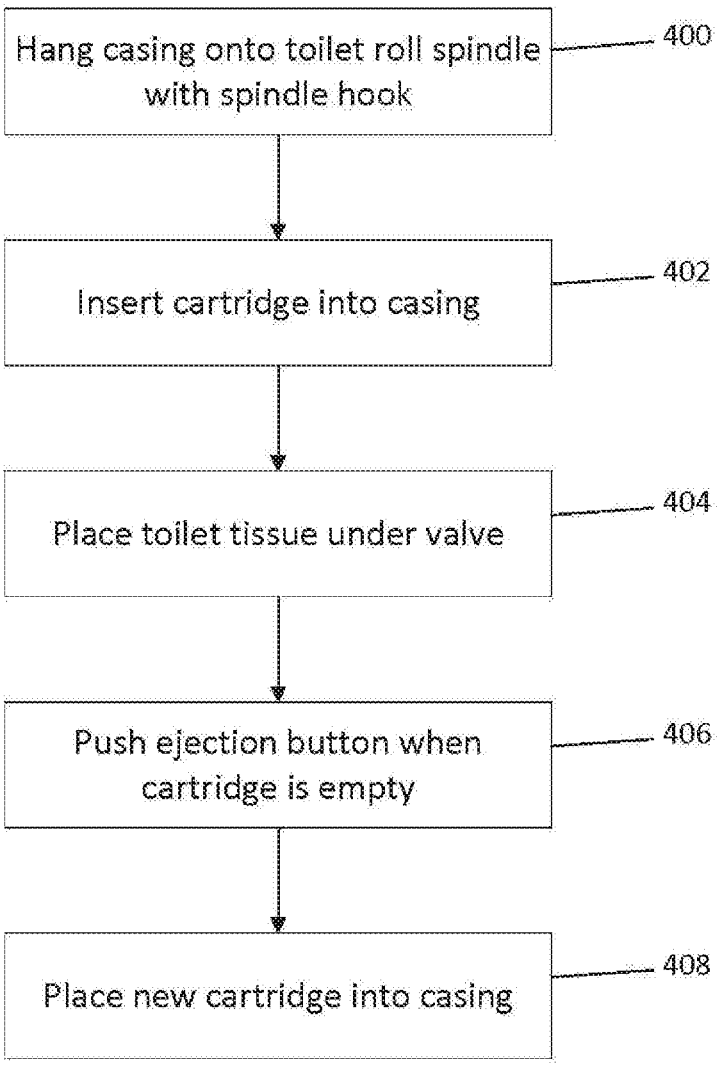
FIG. 16 is a schematic of the method of utilizing the dispenser.

Referring to FIG. 16, a preferred embodiment of the method of using the dispenser is illustrated. First the user hangs the casing onto the toilet roll spindle with the spindle hook 400. The user then inserts the cartridge into the casing 402. The user then uses the cleaning solution in the cartridge by placing toilet tissue under the valve 404. The user pushes the ejection button to eject the cartridge when the cartridge is empty 406. Then the user places a new cartridge into the casing 408.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. An apparatus for dispensing a cleaning solution comprising a) a casing comprising
  i) an external housing having a bottom portion with an outlet port;
  ii) an air pump;
  iii) an injector connected to said air pump; and b) a cartridge comprising
  i) an air tight reservoir containing a cleaning solution;
  ii) a nozzle disposed on a bottom side of said reservoir, said nozzle having an opening disposed at an end point of said nozzle;
  iii) an injection point disposed at a top portion of said reservoir configured to receive said injector;

wherein said injector is configured to puncture a surface of said injection point;

wherein said air pump pumps air through said injector, into a top portion of an internal space of said reservoir above said cleaning solution;

wherein as air is pumped into said top portion of the internal space of said reservoir increased internal air pressure of said reservoir forces said cleaning solution through said nozzle;

wherein said opening of said nozzle is disposed above said outlet port of said external housing; and wherein said cartridge further comprises a metal foil electrical connection disposed on the bottom side of said reservoir;

wherein said casing further comprises one or more electrical connection points wired to said air pump; a cartridge ejection button disposed in said bottom portion;

wherein said one or more electrical connection points are electrically connected to said metal foil electrical connection when said cartridge is fully inserted into said casing;

wherein an internal surface of said cartridge ejection button severs said metal foil electrical connection when said election button is used to eject said cartridge from said casing.

2. The apparatus as in claim 1 wherein said casing further comprises a spindle hook connected to said external housing of said casing;

a rotating arm rotatably connected to said spindle hook; and a thumb screw and a nut removably securing said rotating arm to a portion of said spindle hook.

3. The apparatus as in claim 1 wherein said casing further comprises a transparent window disposed in said external housing;

wherein said reservoir further comprises a transparent portion;

wherein a portion of said cleaning solution is visible through said transparent window of said external housing and said transparent portion of said reservoir when said cartridge is disposed in said casing.

4. The apparatus as in claim 1 further comprising a power source; and an electric motor connected to said air pump.

5. The apparatus as in claim 1 further comprising printed circuit board; and a motion sensor;

wherein said printed circuit board is configured to activate said air pump when said printed circuit board receives an activation signal from said motion sensor.

6. The apparatus as in claim 1 wherein said external housing comprises a side wall having an upper rim defining a top opening;

wherein said cartridge further comprises a top cover;

wherein said top cover is disposed adjacent to said upper rim when said cartridge is placed within said casing.

7. The apparatus as in claim 1 wherein said nozzle further comprises an aerator.

8. The apparatus as in claim 1 further comprising one or more indicator lights.

9. The apparatus as in claim 1 further comprising a valve disposed in said outlet port.

10. The apparatus as in claim 4 further comprising printed circuit board; and a motion sensor;

wherein said printed circuit board is configured to activate said air pump when said printed circuit board receives an activation signal from said motion sensor.

11. The apparatus as in claim 10 wherein said external housing comprises a side wall having an upper rim defining a top opening;

wherein said cartridge further comprises a top cover;

wherein said top cover is disposed adjacent to said upper rim when said cartridge is placed within said casing.

12. The apparatus as in claim 11 wherein said nozzle further comprises an aerator; and a valve disposed in said outlet port.

13. The apparatus as in claim 12 wherein said casing further comprises a transparent window disposed in said external housing;

wherein said reservoir further comprises a transparent portion;

wherein a portion of said cleaning solution is visible through said transparent window of said external housing and said transparent portion of said reservoir when said cartridge is disposed in said casing.

14. The apparatus as in claim 13 further comprising one or more indicator lights;

a spindle hook connected to said external housing of said casing;

a rotating arm rotatably connected to said spindle hook; and a thumb screw and a nut removably securing said rotating arm to a portion of said spindle hook.

15. A method for moistening toilet tissue comprising a) hanging a cleaning solution dispenser from a toilet roll spindle i) said cleaning solution dispenser comprising (1) a casing comprising (a) an external housing having a bottom portion with an outlet port;

(b) an air pump;

(c) an injector connected to said air pump;

(d) a spindle hook connected to said external housing of said casing;

(e) a rotating arm rotatably connected to said spindle hook;

(f) a thumb screw and a nut removably securing said rotating arm to a portion of said spindle hook; and (2) a cartridge comprising (a) an air tight reservoir containing a cleaning solution;

(b) a nozzle disposed on a bottom side of said reservoir, said nozzle having an opening disposed at an end point of said nozzle;

(c) an injection point disposed at a top portion of said reservoir configured to receive said injector wherein said injector is configured to puncture a surface of said injection point;

wherein said air pump pumps air through said injector, into a top portion of an internal space of said reservoir above said cleaning solution;

wherein as air is pumped into said top portion of the internal space of said reservoir increased internal air pressure of said reservoir forces said cleaning solution through said nozzle;

wherein said opening of said nozzle is disposed above said outlet port of said external housing:

wherein said cartridge further comprises a metal foil electrical connection disposed on the bottom side of said reservoir;

wherein said casing further comprises one or more electrical connection points wired to said air pump; a cartridge ejection button disposed in said bottom portion;

wherein said one or more electrical connection points are electrically connected to said metal foil electrical connection when said cartridge is fully inserted into said casing;

wherein an internal surface of said cartridge ejection button severs said metal foil electrical connection when said ejection button is used to eject said cartridge from said casing;

b) confirming a distal end of said rotating arm is disposed against a wall of a room to a sufficient degree to prevent said cleaning solution dispenser from unintentional movement;

c) removing a portion of toilet tissue from a roll of toilet tissue;

d) placing said portion of toilet tissue under said outlet port;

e) confirming desired amount of cleaning solution dispensed from said cleaning solution dispenser is placed on said portion of toilet tissue; and f) removing said portion of toilet tissue from under said outlet port.

16. The method as in claim 15 further comprising a) determining that said cartridge contains an insufficient amount of cleaning solution;

b) ejecting said cartridge from said casing; and c) placing a second cartridge containing a sufficient amount of cleaning solution into said casing.

* * * * *